US006907641B1

(12) United States Patent
Liles

(10) Patent No.: US 6,907,641 B1
(45) Date of Patent: Jun. 21, 2005

(54) REINFORCEMENT BRACKET FOR A BI-FOLD CLOSET DOOR

(76) Inventor: James P Liles, 23240-88th Ave. S., Apt. Y-202, Kent, WA (US) 98031

( * ) Notice: Subject to any disclaimer, the term of this patent is extended or adjusted under 35 U.S.C. 154(b) by 8 days.

(21) Appl. No.: 10/462,854

(22) Filed: Jun. 17, 2003

(51) Int. Cl.[7] ..... A47H 15/00; E05D 15/06

(52) U.S. Cl. ..... 16/97; 16/221; 16/229; 16/87 R; 160/199; 248/220.1

(58) Field of Search ..... 16/97, 102, 105, 16/106, 87 R; 248/220.1, 220.21, 220.31; 160/199, 206, 210, 211, 213; 49/388

(56) References Cited

U.S. PATENT DOCUMENTS

| | | | | |
|---|---|---|---|---|
| 2,028,918 A * | 1/1936 | Panza | 160/229.1 |
| 2,911,176 A * | 11/1959 | Roediger et al. | 248/220.1 |
| 3,049,327 A * | 8/1962 | Caudell | 248/220.1 |
| 5,404,927 A * | 4/1995 | Bailey | 160/201 |
| 5,553,352 A * | 9/1996 | Bolton | 16/229 |
| 5,918,660 A * | 7/1999 | Crawford et al. | 160/201 |
| 6,418,590 B1 * | 7/2002 | Nipper et al. | 16/382 |
| 6,463,625 B2 * | 10/2002 | Mittag | 16/97 |

OTHER PUBLICATIONS

Web site of N-S Enterprises, Inc. (www.n-senterprises.com).

* cited by examiner

*Primary Examiner*—Chuck Mah
(74) *Attorney, Agent, or Firm*—David L. Tingey

(57) ABSTRACT

A bracket that conveys repeated lateral forces on a bi-fold door from an overhead channel on a bi-fold door doorjamb through a common peg and roller to the bi-fold doors without damaging the door. The bracket comprises a horizontal edge plate and a broad vertical brace plate meeting orthogonally at a bracket corner. The horizontal edge plate has a vertical tubular post extending upwardly therefrom for receiving the peg and roller. Alternatively, the horizontal edge plate may have a hole no larger than the drilled hole in the door top edge in which the peg may be is received. To align the brace plate hole with the door hole the bracket may include a vertical edge plate orthogonal to both the horizontal edge plate and the vertical brace plate, extending between them. The vertical edge plate then measures the distance from the door side edge to the door hole as the same distance between the bracket vertical edge plate and the bracket peg hole. To accommodate a door bore smaller than the peg hole provided in the bracket, one or more cylindrical wafer plugs are provided having a portion with an outer diameter matching the peg hole and a plug bore matching the door bore. The wafer plug then adapts the bracket to the smaller door bore by inserting in the bracket peg hole. To accommodate doors of differing thickness with the plate peg hole centered in the door edge, a spacer plate is provided for placement between the bracket brace plate and the door side.

7 Claims, 6 Drawing Sheets

REINFORCEMENT BRACKET FOR A BI-FOLD CLOSET DOOR

BACKGROUND

1. Field of the Invention

This invention pertains to bi-fold closet doors, and more particularly to a corner bracket that reinforces the door's attachment to the doorjamb track.

2. Prior Art

Bi-fold doors are commonly used with closets. Typically, a bi-fold door has two pair of two doors hinged together, a hinge door pivotally connected at its top and bottom near the vertical member of the doorjamb and a lead door guided in an overhead track on the upper horizontal member of the doorjamb. The lead door has a roller on a peg extending upwardly out of a bore in the door top near the door upper corner. The roller moves in the track to guide the doors during opening and closing as the doors fold on the hinges that join them.

The overhead track is typically U-shaped with flanges depending from a web that is screwed into the horizontal member of the doorjamb. Inwardly directed ledges typically extend from flange distal ends toward each other creating a slot entry into the channel. The peg then passes through the slot and the roller is retained in the channel by the opposing channel ledges. At the door, the peg is press-fit into the door bore.

This typical bi-fold configuration is provided convenient access to the closet but has been disadvantageous because when bi-fold doors are repeatedly slammed open or closed, as commonly happens in service, lateral forces act through the peg and roller in stopping door momentum eventually results in damage to the door. As the peg transmits the forces to the door, eventually the door, typically made out of wood or wood products, is unable to sustain the repeated forces and the bore becomes enlarged or the door splinters at the bore. Repair of this damage to the door is a common and can become a costly maintenance item to apartment complexes. Commonly, the peg splinters the side of the door, indicating that the door is generally able to sustain the component of these forces directed toward the door side edge but the splintering door side is unable to sustain the component of the forces in the direction of the door side, which force component is referred to below as the damaging force or forces.

It is known to have a narrow metal corner bracket screwed to the door corner with a horizontal member and vertical member joining orthogonally to form an right angle bracket and having a matching bracket hole in the horizontal member aligned with the door bore over the door top edge. The corner bracket thus mounts to the door edge corner with vertical member screwed onto the door side edge. Although such a bracket improves distribution of the forces to door, it also has disadvantages. Screws in the corner bracket that attach the bracket to the door are still at the door edges and are subject to tearing through the soft wood of the door edge. The vertical member of the corner bracket is unsightly and is also noticeable to a person in front of the door. To avoid the soft edge wood, the bracket might be provided with a lip extending over the door edge to the door side through which screws might secure the bracket to the door back side near the door edge instead of or in addition to the soft door edge.

However, even with additional bracket screws in or near the door edges sharing the forces to the door, repeated forces may splinter the door. And for a bracket with a lip, a different sized bracket must be provided for each sized door if the matching bracket hole is to align with the door bore in the center of the door edge. Also, door bores are of different sizes for different manufacturers again requiring a bracket customized for each bore size. To manufacture a set of brackets that meets all of the varied conditions quickly becomes uneconomic.

SUMMARY

These disadvantages are resolved with a single bracket that conveys repeated lateral, even abusive, forces from the channel through a common peg and roller to the bi-fold doors without damaging the door.

The bracket comprises a broad angle bracket with a horizontal edge plate and a vertical brace plate meeting orthogonally at a bracket corner where the vertical brace plate extends down from the horizontal edge plate a substantial length. To absorb change in momentum from the door slamming to a stop, the brace plate length is at least that of the depth of the horizontal edge plate from the brace plate and more commonly the length of the horizontal edge plate along its union with the brace plate at the bracket corner. For purposes throughout this disclosure, the depth of the horizontal edge plate refers to a direction orthogonal to the brace plate and along the thickness of the door at the top of the door when the bracket is installed and the length of the horizontal edge plate refers to a direction orthogonal to the depth of the horizontal edge plate and parallel with the bracket corner.

When mounted to a door with the horizontal edge plate over a door top edge and the vertical brace plate mounted on the door back side, the bracket is not viewable from the front of the door. That is, the depth of the bracket horizontal edge plate is less than the door thickness so it does not extend past the door front side; as noted, the brace plate is broad for distributing the load from the peg over a broad area of the door back side when mounting against it. The peg must position near the door corner for it to serve as a door guide in the overhead channel. The horizontal edge plate therefore has a vertical post extending upwardly therefrom to which a roller may be attached. Typically, the post has a longitudinal post bore for receiving a peg having a roller on a peg upper end outside of the post.

Alternatively, the horizontal edge plate may have a hole no larger than the drilled hole in the door top edge in which the peg commonly is received. To align the brace plate hole with the door hole the bracket may include a vertical edge plate orthogonal to both the horizontal edge plate and the vertical brace plate, extending between them. The vertical edge plate then measures the distance from the door side edge to the door hole as the same distance between the bracket vertical edge plate and the bracket peg hole.

Thus, the damaging lateral forces are no longer conveyed through the peg to the door at the door hole or even through additional screws in or near the door edge to the door through a corner bracket. Instead those damaging forces are transmitted through the peg fitting in the bracket peg hole and then broadly to the brace plate. The consequence is that screws that secure the bracket to the door no longer are convey forces to the peg, but are primarily for securing the bracket to the door. That is, the impact of slamming the door that previously would cause the peg to splinter the side of the door is absorbed broadly over the brace plate. In effect, the peg stops the bracket instead of stopping the door as in prior configurations; the door is stopped as being part of the bracket so the stopping force is dissipated over the full area of the bracket brace plate. The door is effectively running into a broad plate rather than a thin peg. The door about the door hole and the plate screws do not absorb the damaging lateral forces. Thus, damage to the door is averted.

To accommodate a door bore smaller than the peg hole provided in the bracket, one or more cylindrical wafer plugs are provided having a portion with an outer diameter matching the peg hole and a plug bore matching the door bore. The wafer plug then adapts the bracket to the smaller door bore by inserting in the bracket peg hole. Several wafer plugs of differing plug bores adapt the bracket to the wide variety of doors.

To accommodate doors of differing thickness with the plate peg hole centered in the door edge, a spacer plate is provided for placement between the bracket brace plate and the door side. Doors are typically either 1⅛ inches or 1⅜ inches. If the bracket were configured to fit a 1⅜ inch door, the bracket is centered in the 1⅜ door by employing a spacer plate with a width of half of the difference in the door widths, or ⅛ inch. Screw holes are in the spacer plate aligned with screw holes in the bracket brace plate.

DETAILED DESCRIPTION OF THE PREFERRED EMBODIMENTS

Figure 1:
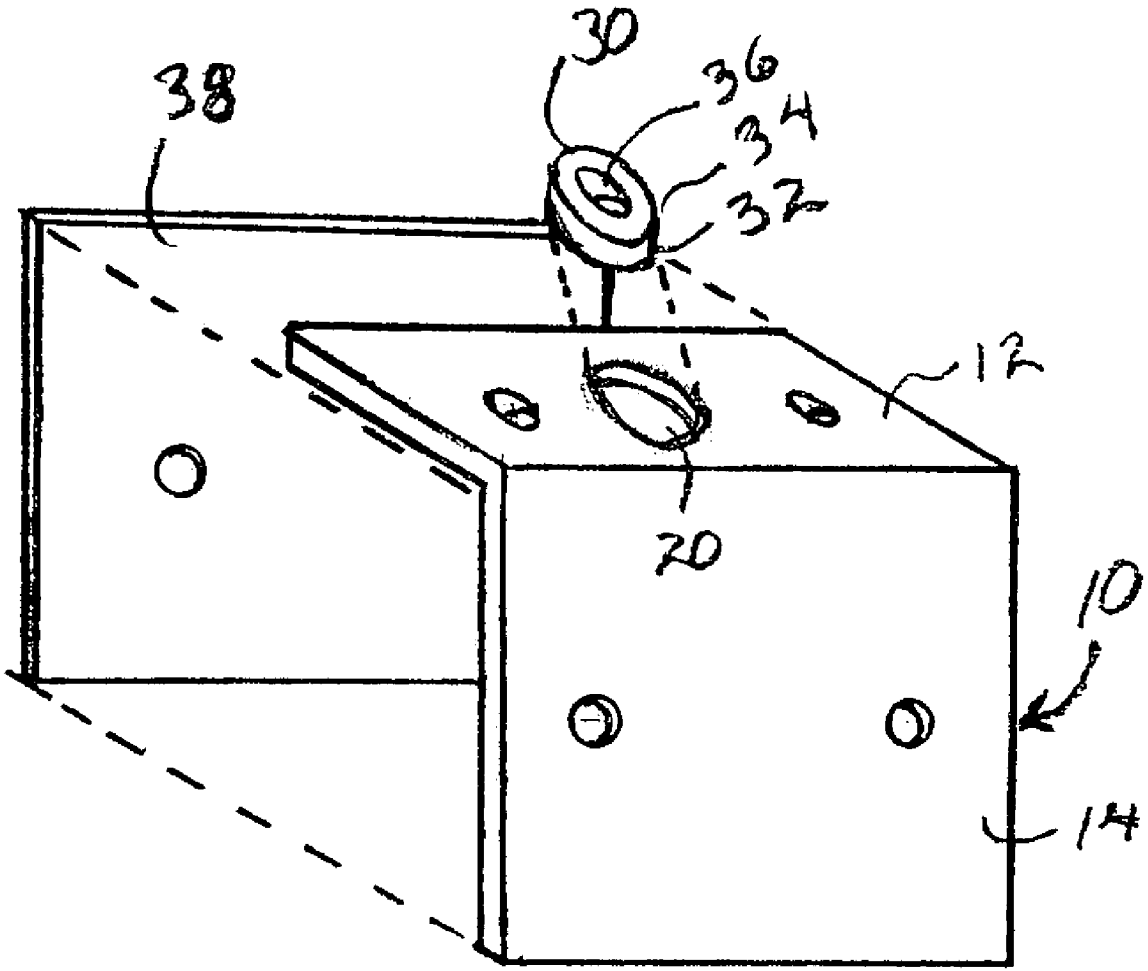
FIG. 1 is a perspective view of the bracket of the present invention shown with a wafer plug and a spacer plate.
Figure 2:
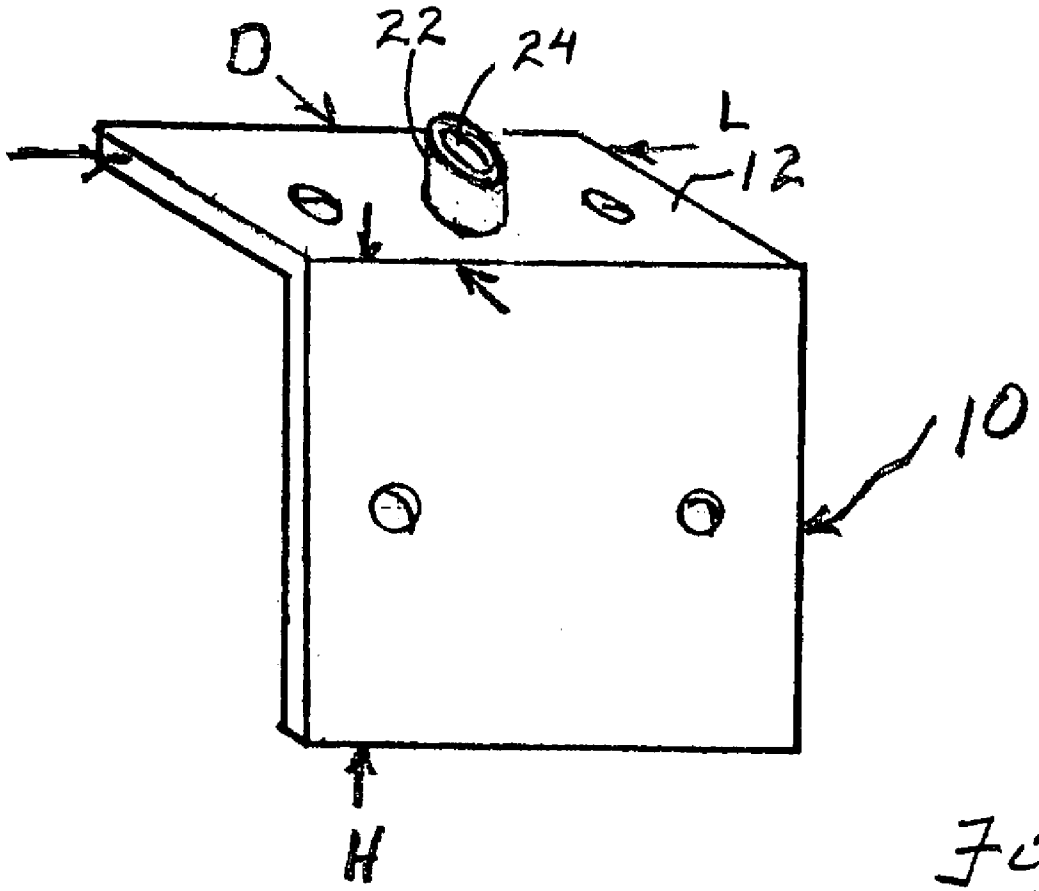
FIG. 2 is an perspective view of the bracket including a post extending upward from the bracket with a longitudinal hole for receiving a peg on which a roller is rotatably mounted.
Figure 3A:
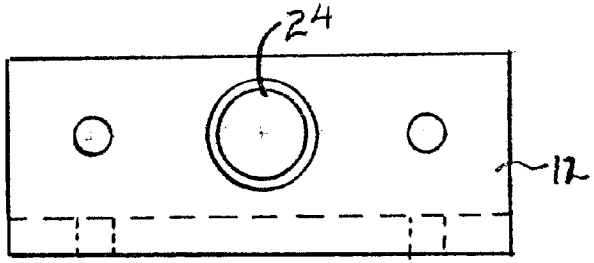
FIGS. 3*a*, 3*b*, and 3*c* is top, end and side views of the bracket of FIG. 2. of FIG. 2 shown on a door.
Figure 3B:
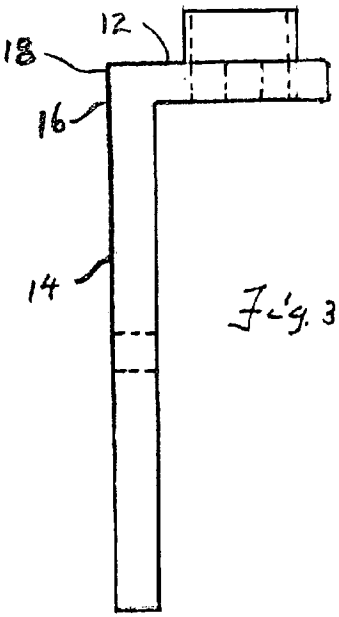
Figure 3C:
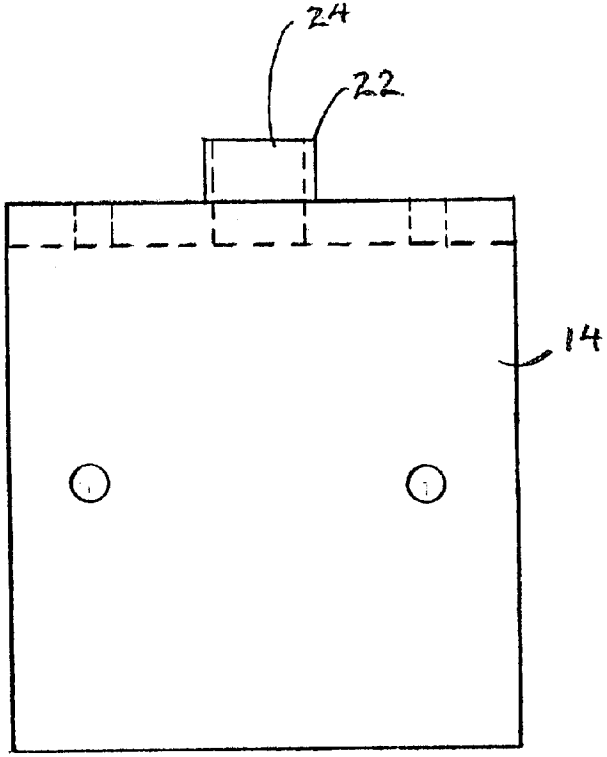
Figure 4:
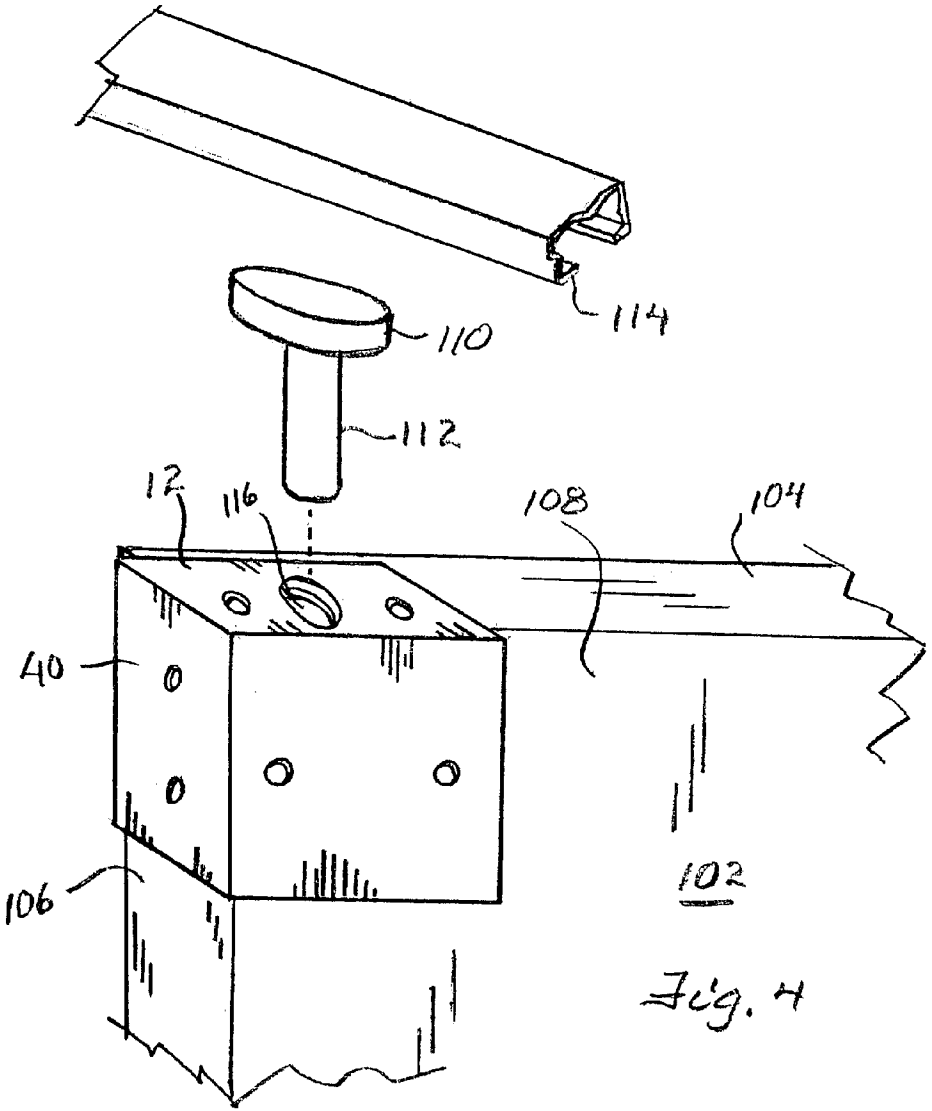
FIG. 4 is a perspective view of the bracket with a vertical edge plate orthogonal to both the horizontal edge plate and the brace plate forming a cubical corner, shown in relation to a door corner.
Figure 5:
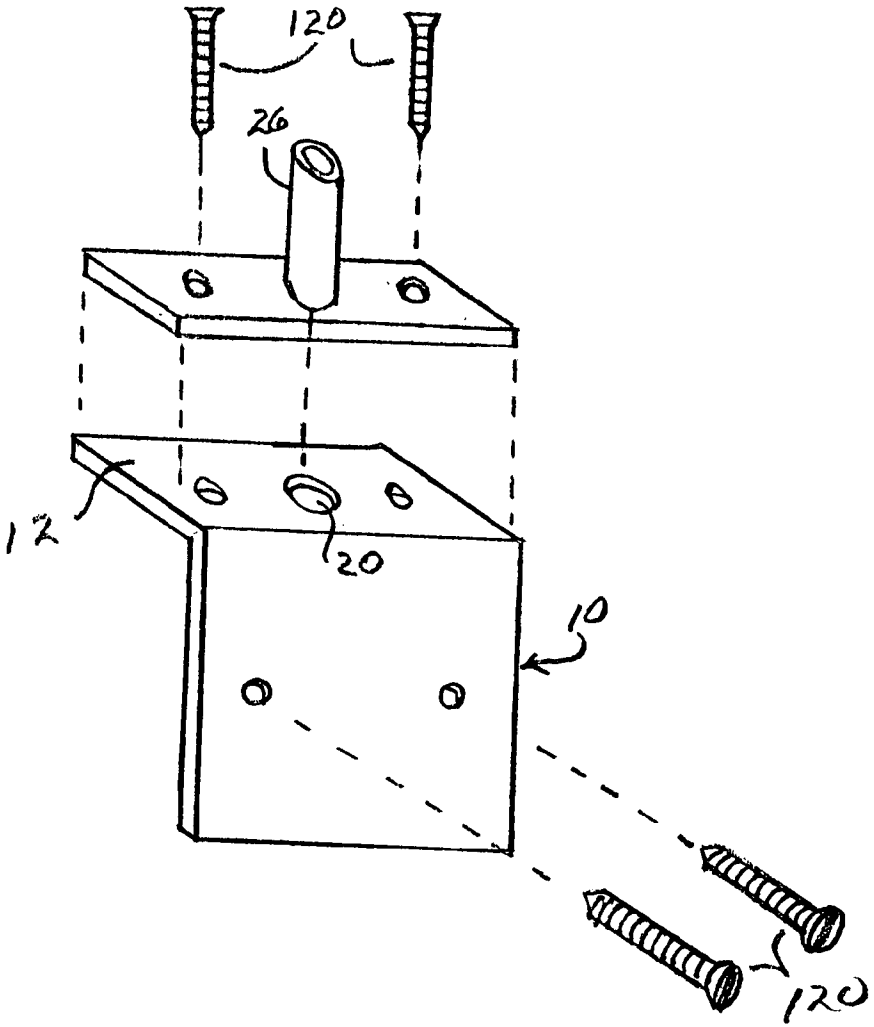
FIG. 5 is a perspective view of the bracket post mounted by screws on bracket horizontal edge plate.
Figure 6:
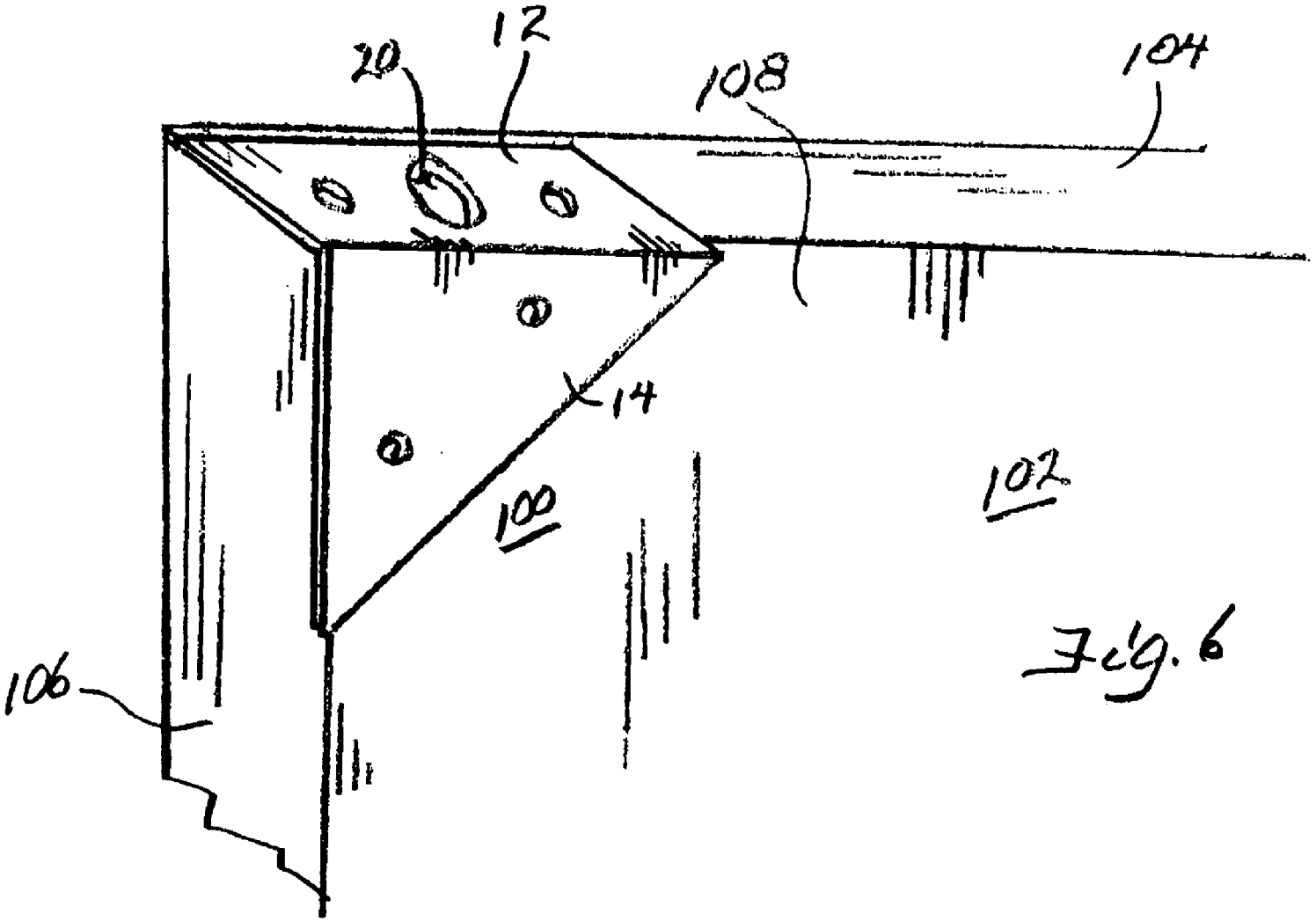
FIG. 6 is a perspective view of the bracket with a triangular brace plate mounted on a door back side and top edge.

The bi-fold door bracket 10 of the present invention is provided for attachment on a support corner 100 of a typical bi-fold door 102 with top and side edges 104 and 106 and a back side 108 and roller 110 on a peg 112 which roller moves in an overhead channel 114 to guide the door as it folds and unfolds. The bracket 10 primarily comprises a horizontal edge plate 12, with a depth D sized less than the door top edge 104 and a length L greater than its depth D, and a vertical brace plate 14 with a top 16 meeting the horizontal edge plate length orthogonally L at a bracket corner 18. To distribute impact forces to the door back side 108 when mounted on the door 102, the brace plate 14 has a vertical height H at least as long as the depth D of the horizontal edge plate 12 from the brace plate 14 and more commonly at least as long as the horizontal edge plate length L therein providing a broad surface mountable in face-to-face contact with the door 102. The horizontal edge plate 12 is typically of square shape but may also be of triangular shape.

The bracket horizontal edge plate 12 includes a hole 20 adapted to receive the peg 112 as a connection apparatus of the peg 112 to the door 102 located to align with a door hole 116 drilled to receive the peg 112 when the bracket 10 is mounted to a door 102, the bracket 10 interposing connection from the overhead channel 114 which in turn connects to the door 102 but not at the door hole 116 but over the broad area of the brace plate 14.

In an alternative embodiment, the bracket 10 may comprise a vertical, typically tubular, post 22 extending upwardly from the horizontal edge plate 12 with a longitudinal post bore 24 sized to receive the peg 112. The bore 24 is located to align approximately with the door hole 116 when the bracket 10 is mounted to a door 102, substituting the post bore 24 for the door hole 116 in providing an improved interconnection between the peg 112 and the bracket 10 and hence the door 102. The post 22 may be integrated into the bracket horizontal edge plate 12 or it may comprise a tubular member 26 removably mounted, by screws 120 or the equivalent, to the bracket horizontal edge plate 12 with the tubular member 26 approximately over the door hole 116 provided to receive the peg 112 when the bracket 10 is mounted to a door 102. The peg 112 is then removably receivable into the tubular member 26.

To adapt a single sized bracket with a single sized hole, which may be larger than the peg on some doors, a cylindrical wafer plug 30 is provided as an insert into the bracket hole 20. The wafer plug 30 has a cylindrical portion 32 with an outer diameter 34 matching and received into the bracket hole 20 and a plug bore 36 matching the peg 112, the wafer plug 30 effectively reducing the bracket hole 20 to the size of the peg. To adapt the single sized bracket to doors of different width and therefore different position of the door hole, a spacer plate 38 is provided, intended to fit in face-to-face contact with the brace plate 14 under the horizontal edge plate 12 to space the brace plate 14 a measured distance from the door back side 108 so the bracket hole 20 in the horizontal edge plate 12 aligns with a door hole 116 provided to receive the peg 112.

The bracket 10 may further comprise a vertical edge plate 40 orthogonal to both the horizontal edge plate 12 and the vertical brace plate 14 for further securing the bracket 10 to the door 102 and to measure the location of the bracket 10 from the door side edge 106 as the vertical brace plate 14 is mounted in face-to-face contact with the door side edge 106. The vertical edge plate 40 extends between the horizontal edge plate 12 and brace plate 14, together forming a cubical corner sized to fit in face-to-face contact with the door top and side edges and back side.

What is claimed is:

1. A bi-fold door bracket for attachment on a support corner of a bi-fold door, the door having a thickness and top and side edges and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg received into the channel such that the roller moves in the channel as the door folds during opening and closing the improvement comprising a horizontal edge plate with a depth sized less than the thickness of the thickness of the door top edge and a length greater than its depth, a vertical brace plate with a top meeting the horizontal edge plate length orthogonally at a bracket corner, the brace plate having a vertical height at least as long as the depth of the horizontal edge plate from the brace plate as a broad surface disposed to distribute impact forces to the door back side when mounted thereon, a connection apparatus comprising a bracket hole in the horizontal edge plate adapted to receive a peg therein and located to align with a door hole when the bracket is mounted to a door, the peg having a roller on an end outside the connection apparatus sized to engage the overhead track, and, wherein the bracket hole is larger than the peg, a cylindrical wafer plug having a portion with an outer diameter matching the bracket hole received into the bracket hole and a plug bore matching the peg, the wafer plug effectively reducing the bracket hole to the peg.

2. A bi-fold door bracket for attachment on a support corner of a bi-fold door, the door having a thickness and top and side edges and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg received into the channel such that the roller moves in the channel as the door folds during opening and closing, the improvement comprising a horizontal edge plate with a depth sized less than the thickness of the door top edge and a length greater than its depth, a vertical brace plate with a top meeting the horizontal edge plate length orthogonally at a bracket corner, the brace plate having a vertical height at least as long as the depth of the horizontal edge plate from the brace plate as a broad surface disposed to distribute impact forces to the door back side when mounted thereon, a connection apparatus comprising a bracket hole in the horizontal edge plate adapted to receive a peg therein and located to align with a door hole when the bracket is mounted to a door, the peg having a roller on an end outside the connection apparatus sized to engage the overhead track, and, a spacer plate adapted to fit in face-to-face contact with the brace plate under the horizontal edge plate to space the brace plate a measured distance from the door back side so the bracket hole in the horizontal edge plate aligns with a door hole provided to receive the peg.

3. A bi-fold door bracket for attachment on a support corner of a bi-fold door, the door having a thickness and top and side edges and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg received into the channel such that the roller moves in the channel as the door folds during opening and closing, the improvement comprising a horizontal edge plate with a depth sized less than the thickness of the door top edge and a length greater than its depth, a vertical brace plate with a top meeting the horizontal edge plate length orthogonally at a bracket corner, the brace plate having a vertical height at least as long as the depth of the horizontal edge plate from the brace plate as a broad surface disposed to distribute impact forces to the door back side when mounted thereon, a connection apparatus on the horizontal edge plate adapted to receive a peg therein, the peg having a roller on an end outside the connection apparatus sized to engage the overhead track, wherein the connection apparatus comprises a vertical post extending upwardly from the horizontal edge plate with a longitudinal post bore sized to receive the peg and located to align approximately with a door hole when the bracket is mounted to a door.

4. A bi-fold door bracket for attachment on a support corner of a bi-fold door, the door having a thickness and top and side edges and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg received into the channel such that the roller moves in the channel as the door folds during opening and closing the improvement comprising a horizontal edge plate with a depth sized less than the thickness of the door top edge and a length greater than its depth, a vertical brace plate with a top meeting the horizontal edge plate length orthogonally at a bracket corner, the brace plate having a vertical height at least as long as the depth of the horizontal edge plate from the brace plate as a broad surface disposed to distribute impact forces to the door back side when mounted thereon, a connection apparatus on the horizontal edge plate adapted to receive a peg therein, the peg having a roller on an end outside the connection apparatus sized to engage the overhead track, wherein the peg connection apparatus comprises a tubular member extended upward from a horizontal plate member removably mounted to the bracket horizontal edge plate with the tubular member approximately over a door hole provided to receive the peg when the bracket is mounted to a door, the peg removably receivable into the tubular member.

5. A bi-fold door bracket for attachment on a support corner of a bi-fold door, the door having a thickness and top and side edges and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg received into the channel such that the roller moves in the channel as the door folds during opening and closing the improvement comprising a horizontal edge plate with a depth sized less than the thickness of the door top edge and a length greater than its depth, a vertical brace plate with a top meeting the horizontal edge plate length orthogonally at a bracket corner, the brace plate having a vertical height at least as long as the depth of the horizontal edge plate from the brace plate as a broad surface disposed to distribute impact forces to the door back side when mounted thereon, a connection apparatus on the horizontal edge plate adapted to receive a peg therein, the peg having a roller on an end outside the connection apparatus sized to engage the overhead track, a vertical edge plate orthogonal to both the horizontal edge plate and the vertical brace plate, extending between them, the vertical brace plate, horizontal edge plate and the vertical edge plate forming a cubical corner sized to fit in face to face contact with the door top and side edges and back side.

6. A bi-fold door bracket for attachment on a support corner of a bi-fold door, the door having a thickness and top and side edges and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg received into the channel such that the roller moves in the channel as the door folds during opening and closing, the improvement comprising a horizontal edge plate with a depth sized less than the thickness of the door top edge and a length greater than its depth, a vertical brace plate with a top meeting the horizontal edge plate length orthogonally at a bracket corner, the brace plate having a vertical length at least as long as the horizontal edge plate length as a broad surface disposed to distribute impact forces to the door back side when mounted thereon, a vertical post extending upwardly from the horizontal edge plate with a longitudinal post bore sized to receive the peg and located to align approximately with a door hole when the bracket is mounted to a door adapted to receive a peg therein, the peg having a roller on an end outside the connection apparatus sized to engage the overhead track, a vertical edge plate orthogonal to both the horizontal edge plate and the vertical brace plate, extending between them, the vertical brace plate, horizontal edge plate and the vertical edge plate forming a cubical corner sized to fit in face to face contact with the door top and side edges and back side.

7. A bi-fold door bracket for attachment on a support corner of a bi-fold door, the door having a thickness and top and side edges and a hole in its top edge and comprising a pivot door mounted pivotally to a doorjamb vertical member and a lead door hingedly connected to the pivot door, the lead door and pivot door folding together during opening and closing as the pivot door pivots at the doorjamb vertical member, the bracket adapted to link the door corner to an overhead channel on a doorjamb horizontal member through a roller on a peg receivable in the door hole with the roller received into the channel such that the roller moves in the channel as the door folds during opening and closing, the improvement comprising a horizontal edge plate with a depth sized less than the thickness of the door top edge and a length greater than its depth and a hole adapted to receive the peg located to align with the door hole when the bracket is mounted to a door, a vertical brace plate with a top meeting the horizontal edge plate length orthogonally at a bracket corner, the brace plate having a vertical height at least as long as the depth of the horizontal edge plate from the brace plate as a broad surface disposed to distribute impact forces to the door back side when mounted thereon, a vertical post extending upwardly from the horizontal edge plate with a longitudinal post bore sized to receive the peg and located to align approximately with a door hole when the bracket is mounted to a door adapted to receive a peg therein, the peg having the roller on an end outside the connection apparatus sized to engage the overhead track, a vertical edge plate orthogonal to both the horizontal edge plate and the vertical brace plate, extending between them, the vertical brace plate, horizontal edge plate and the vertical edge plate forming a cubical corner sized to fit in face to face contact with the door top and side edges and back side.

* * * * *